US010577996B2

(12) United States Patent
Alcenius et al.

(10) Patent No.: US 10,577,996 B2
(45) Date of Patent: Mar. 3, 2020

(54) EXHAUST CONDUIT WITH A FLOW CONDITIONING PORTION

(71) Applicant: Caterpillar Inc., Peoria, IL (US)

(72) Inventors: Tim Alcenius, Dunlap, IL (US); Daniel Barb, East Peoria, IL (US); Steve Burch, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 55 days.

(21) Appl. No.: 15/848,380

(22) Filed: Dec. 20, 2017

(65) Prior Publication Data

US 2019/0186322 A1 Jun. 20, 2019

(51) Int. Cl.
*F01N 13/08* (2010.01)
*F01N 3/28* (2006.01)

(52) U.S. Cl.
CPC ..... *F01N 3/2892* (2013.01); *F01N 13/08* (2013.01); *F01N 2240/20* (2013.01); *F01N 2470/00* (2013.01)

(58) Field of Classification Search
CPC .... F01N 1/088; F01N 3/2892; F01N 2240/20; F01N 2470/18; B01F 5/0616–0619; B01F 2005/0638; B01F 2005/0639
See application file for complete search history.

(56) References Cited

U.S. PATENT DOCUMENTS 5,099,879 A * 3/1992 Baird ..... F15D 1/02 137/561 A
5,916,134 A * 6/1999 Yang ..... F01N 3/2892 60/299
9,718,037 B2 * 8/2017 Harmon ..... B01F 5/0473
2007/0263486 A1 * 11/2007 Suhner ..... B01F 5/0643 366/337
2009/0025392 A1 * 1/2009 Wirth ..... B01F 3/022 60/694
2010/0074814 A1 * 3/2010 Drost ..... B01F 5/0616 422/225
2010/0218490 A1 * 9/2010 Forster ..... B01F 5/0451 60/324
2010/0293931 A1 * 11/2010 Peters ..... B01D 53/9431 60/324
2013/0104531 A1 * 5/2013 Cho ..... B01F 3/04049 60/302
2015/0198073 A1 7/2015 Jujare et al.

FOREIGN PATENT DOCUMENTS

DE 102012021017 4/2014
JP 8246875 9/1996
JP H10185480 7/1998

* cited by examiner

*Primary Examiner* — Jonathan R Matthias
(74) *Attorney, Agent, or Firm* — Calfee, Halter & Griswold LLP

(57) ABSTRACT

An exhaust conduit having a wall with an inner surface that at least partially defines a flow channel, a first fin positioned within the flow channel and attached to the inner surface, a second fin positioned within the flow channel and attached to the inner surface such that the first fin is spaced apart from the second fin. A support strip is attached to the inner surface, attached to the first fin at a first location spaced apart from the inner surface, and attached to the second fin at a second location spaced apart from the inner surface.

18 Claims, 4 Drawing Sheets

EXHAUST CONDUIT WITH A FLOW CONDITIONING PORTION

TECHNICAL FIELD

The present disclosure relates generally to an exhaust conduit, and more particularly, to an exhaust conduit having a flow conditioning portion.

BACKGROUND

Many engine systems include an exhaust aftertreatment system for treating the exhaust exiting the engine. Exhaust aftertreatment systems can include a variety of components and subsystems for treating the exhaust, such as a diesel oxidation catalyst, a diesel particulate filter, selective catalytic reduction system, and an ammonia oxidation catalyst.

In some engine systems, the exhaust conduit or pipe used to transfer exhaust from the engine to the exhaust aftertreatment system may include internal structure, such as baffles or vanes, to condition the flow of the exhaust or aid in treating the exhaust. In the system of German Patent Publication No. 102012021017A1, to Braun et al., three baffle elements are welded to a transfer pipe or interior wall of a first exhaust gas duct. The baffle elements are spaced apart in the direction of the longitudinal axis of the transfer and parallel to one another. A reducing agent injector is arranged such that the injection stream at least partially impinges onto a major baffle surface of each of the baffles.

SUMMARY

In one aspect, an exhaust conduit includes a wall having an inner surface that at least partially defines a flow channel, a first fin positioned within the flow channel and attached to the inner surface, a second fin positioned within the flow channel and attached to the inner surface, where the first fin is spaced apart from the second fin, and a support strip attached to the inner surface, attached to the first fin at a first location spaced apart from the inner surface, and attached to the second fin at a second location spaced apart from the inner surface.

In another aspect, an engine system includes an engine, an exhaust aftertreatment system, and an exhaust conduit for directing flow from the engine to the exhaust aftertreatment system. The exhaust conduit a wall having an inner surface that at least partially defines a flow channel, a first fin positioned within the flow channel and attached to the inner surface, a second fin positioned within the flow channel and attached to the inner surface, where the first fin is spaced apart from the second fin, and a support strip attached to the inner surface, attached to the first fin at a first location spaced apart from the inner surface, and attached to the second fin at a second location spaced apart from the inner surface.

In another aspect, a method of supporting a plurality of fins in an exhaust conduit includes attaching the first and second lateral edges of a first fin to an inner surface of the exhaust conduit, attaching the first and second lateral edges of a second fin to the inner surface, connecting a first point on the first fin to a second point on the second fin, wherein the first point and the second point are radially inward from the inner surface, and connecting the first point to the inner surface at a location spaced apart from the first and second lateral edges of a first fin.

BRIEF DESCRIPTION OF THE DRAWINGS

Further features and advantages of the invention will become apparent from the description of embodiments using the accompanying drawings. In the drawings.

DETAILED DESCRIPTION

Figure 1:
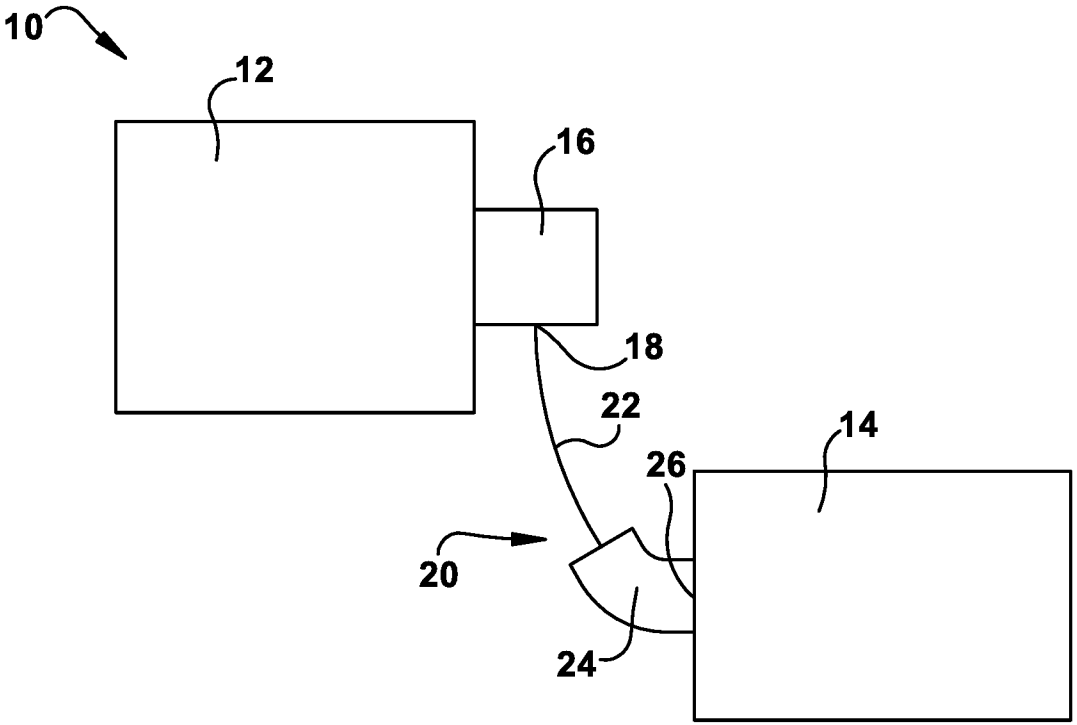
FIG. 1 is a schematic view of an exemplary engine and exhaust aftertreatment system according to the present disclosure.

Referring to FIG. 1, an exemplary embodiment of an engine and exhaust aftertreatment system 10 includes an engine 12, such as a diesel engine, and an exhaust aftertreatment system 14. The engine 12 may include one or more turbochargers 16 defining one or more exhaust exits 18. Exhaust exiting the turbochargers 16 via the one or more exhaust exits 18 is directed to the exhaust aftertreatment system 14 via an exhaust conduit 20.

The exhaust aftertreatment system 14 may be configured in a variety of ways. For example, the exhaust aftertreatment system 14 may include, but not be limited to, one or more of a diesel oxidation catalyst, a diesel particulate filter, selective catalytic reduction system, and an ammonia oxidation catalyst. The components of the exhaust aftertreatment system 14 may be arranged individually or may be grouped together into one or more modules.

The exhaust conduit 20 may be configured in a variety of ways. For example, the length, size, shape, and materials used for the exhaust conduit 20 may vary in different embodiments. The exhaust conduit 20 may include multiple components or a single component. At least a portion of the exhaust conduit 20 includes one or more flow conditioners configured to condition the flow of the exhaust entering the exhaust aftertreatment system 14. As used in this application, "condition the flow" means eliminating or reducing swirl and/or non-symmetry of the flow. For example, conditioning the flow of exhaust through an elbow pipe may include structure to turn the flow to reduce the amount of swirl in the flow as compared to the same elbow without the structure.

In the illustrated embodiment, the exhaust conduit 20 includes a flex portion 22, such as a metal bellows, and an elbow 24 positioned at an inlet 26 to the exhaust aftertreatment system 14. The elbow 24 in the illustrated embodiment includes one or more flow conditioners. In other embodiments, however, the one or more flow conditioners may be positioned in another portion of the exhaust conduit 20, such as for example, in a straight portion or in a flex portion. The one or more flow conditioners may be positioned at any suitable location in the exhaust conduit 20.

Figure 2:
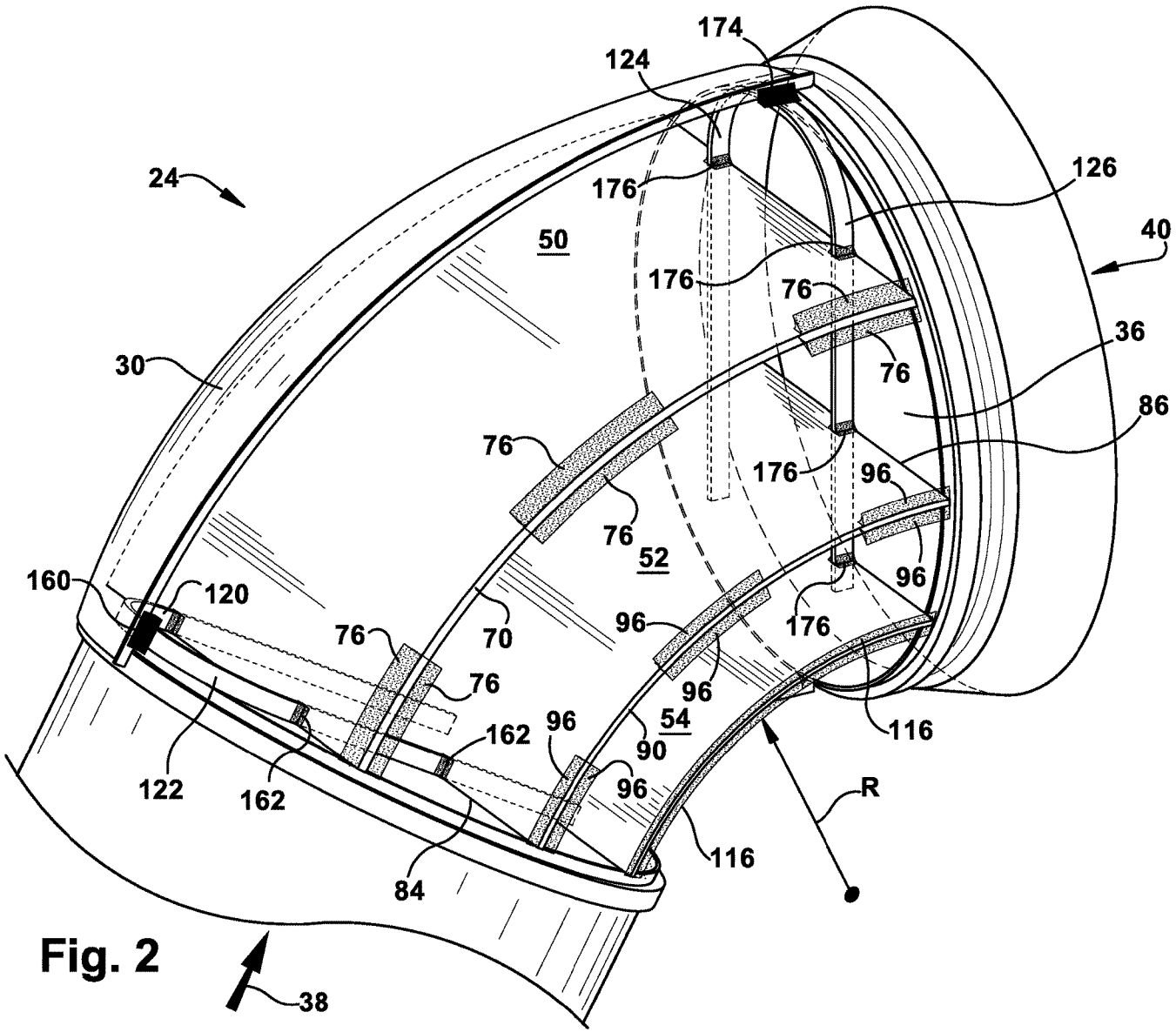
FIG. 2 is a sectioned view of an exemplary embodiment of an exhaust conduit for the engine and exhaust aftertreatment system of FIG. 1.
Figure 3:
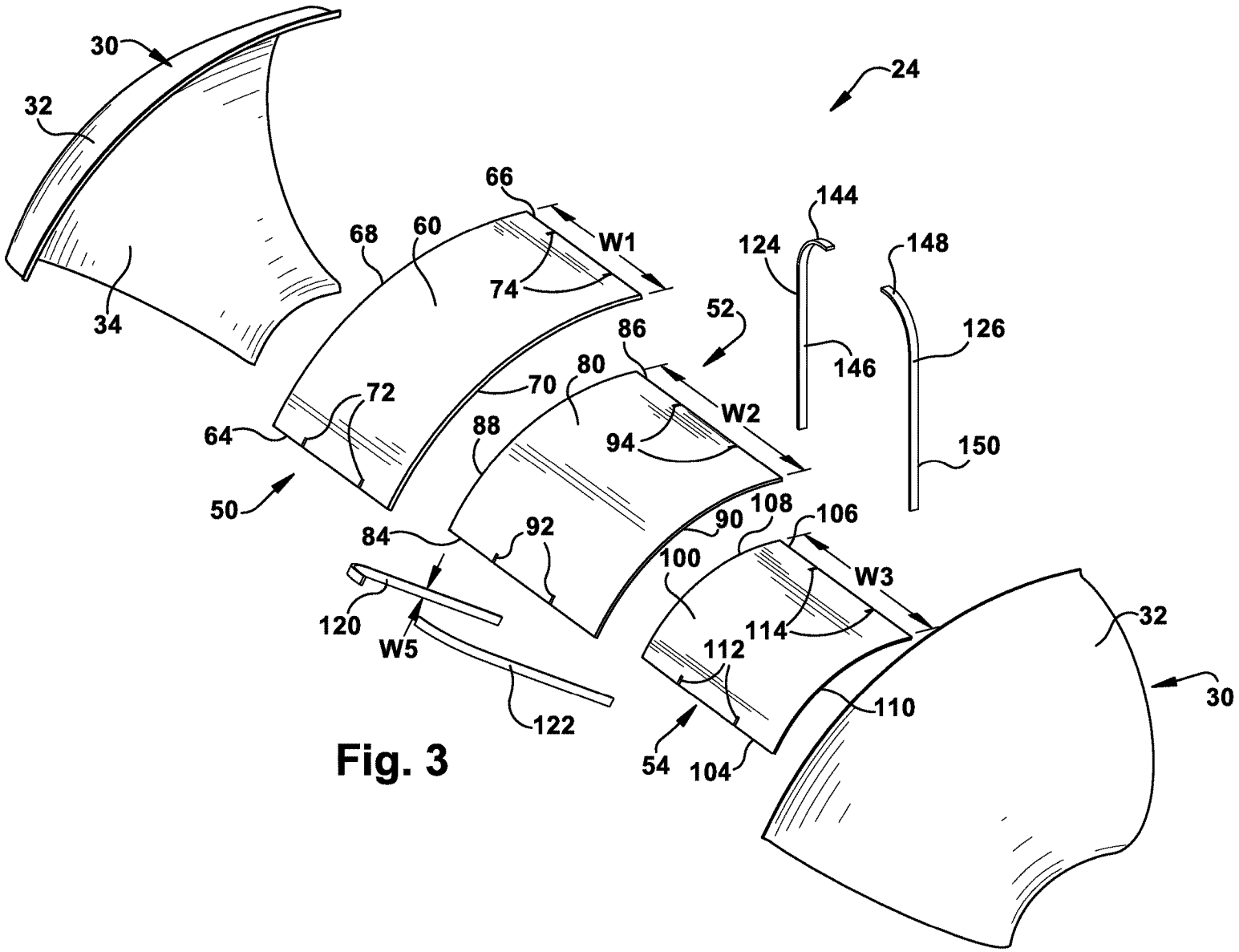
FIG. 3 is an exploded view of the exhaust conduit of FIG. 2.
Figure 4:
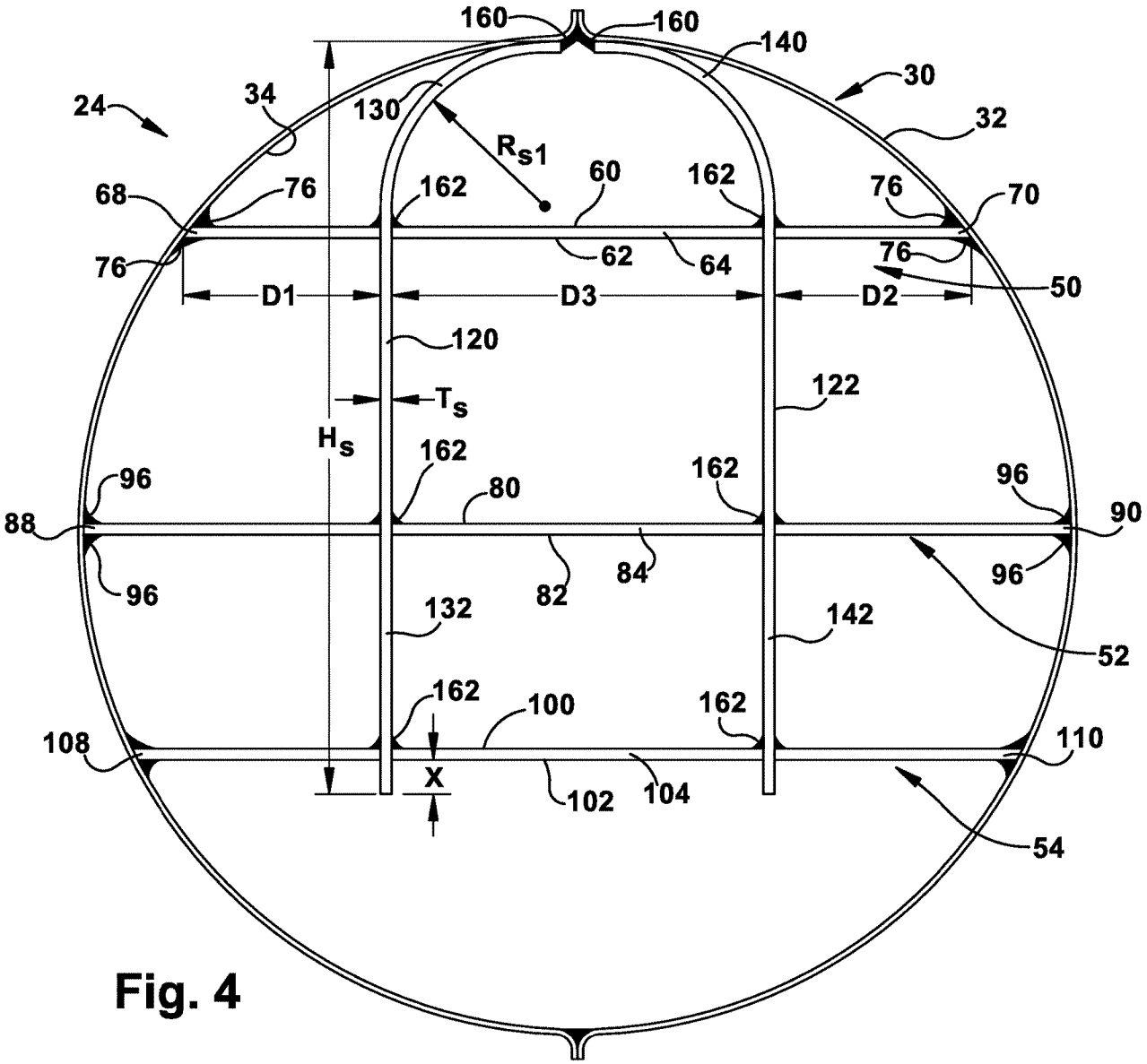
FIG. 4 is a front view of the inlet end of the exhaust conduit of FIG. 2.

Referring to FIGS. 2-4, the elbow 24 includes one or more cylindrical sidewalls 30 having an outer surface 32 and an inner surface 34 generally parallel to and opposite the outer surface 32. The inner surface 34 defines a flow channel 36 having an inlet 38 and an outlet 40. The elbow 24 has a radius of curvature R. In the illustrated embodiment, the radius of curvature is constant and the elbow 24 bends to an angle of 45 degrees. In other embodiments, however, the radius of curvature may not be constant and the elbow 24 may bend to an angle greater than or less than 45 degrees.

The one or more flow conditioners associated with the elbow 24 may be configured in a variety of ways. Any structure that can suitably condition the flow of exhaust entering the exhaust aftertreatment system 14 may be used.

In the illustrated embodiment, the one or more flow conditioners include a plurality of curved fins. As show in FIGS. 2-4, the elbow 24 includes a first fin 50, a second fin 52, and a third fin 54. In other embodiments, however, the elbow 24 may include less than or more than three fins.

Each of the fins 50, 52, 54 is generally a thin plate that is curved to match the curvature of the elbow 24. The fins 50, 52, 54 are positioned within the flow channel 36 and are evenly spaced apart and parallel to each other. In other embodiments, however, the fins 50, 52, 54 may not be evenly spaced apart and/or parallel to each other. For example, in some embodiments, the spacing between the first fin 50 and second fin 54 may be greater than or less than the spacing between the second fin 52 and the third fin 54. In addition, the spacing between any two fins may vary along the length of the fins or along the width of the fins.

The fins 50, 52, 54 may be made of any suitable material for conditioning exhaust flow. In the exemplary embodiment, the fins 50, 52, 54 are made of sheet metal, such as for example, 11 GA sheet metal.

The first fin 50 includes a first face 60, a second face 62 generally parallel to and opposite the first face 62, a leading edge 64 extending between the first face 60 and the second face 62, a trailing edge 66 opposite the leading edge 64 and extending between the first face 60 and the second face 62, a first lateral edge 68 extending between the leading edge 64 and the trailing edge 66, and a second lateral edge 70 opposite the first lateral edge 68 and extending between the leading edge 64 and the trailing edge 66. The first fin 50 has a width W1 that is generally constant along its length. In other embodiments, however, the width W1 of the first fin 50 may vary along its length.

The first fin 50 may include a portion configured to connect to supporting structure that connects the first fin 50, the second fin 52, and the third fin 54 together. The portion on the first fin 50 for connecting to the support structure may be configured in a variety of ways. In the illustrated embodiment, the first fin 50 includes a pair of recesses 72 at the leading edge 64 for receiving support structure and a pair of recesses 74 at the trailing edge 66 for receiving support structure. The size, shape, location, and number of recesses for receiving support structure may vary with different embodiments. In the illustrated embodiment, the pairs of recesses 72 at the leading edge 64 and the pair of recesses 74 at the trailing edge 66 are generally rectangular slots.

The first fin 50 may be fixed relative to the cylindrical sidewall 30. The first fin 50 may be fixed relative to the cylindrical sidewall 30 by any suitable means. In the illustrated embodiment, the first fin 50 is attached to the inner surface 34 of the cylindrical sidewall 30 along at least a portion of the first lateral edge 68 and the second lateral edge 70. In the illustrated embodiment, the first fin 50 is attached to the inner surface 34 by welds 76 along both the first lateral edge 68 and the second lateral edge 70. The welds 76 are spaced apart along the first lateral edge 68 and the second lateral edge 70. In one embodiment, each of the welds 76 are about two-inch long and are evenly spaced apart along the first lateral edge 68 and the second lateral edge 70. In other embodiments, however, the first lateral edge 68 and the second lateral edge 70 may be welded along their entire length or the spacing and length of the welds may vary.

Similar to the first fin 50, the second fin 52 includes a first face 80, a second face 82 generally parallel to and opposite the first face 82, a leading edge 84 extending between the first face 80 and the second face 82, a trailing edge 86 opposite the leading edge 84 and extending between the first face 80 and the second face 82, a first lateral edge 88 extending between the leading edge 84 and the trailing edge 86, and a second lateral edge 90 opposite the first lateral edge 88 and extending between the leading edge 84 and the trailing edge 86. The second fin 52 has a width W2 that is generally constant along its length. In other embodiments, however, the width W2 of the second fin 52 may vary along its length.

The second fin 52 may include a portion configured to connect to supporting structure that connects the first fin 50, the second fin 52, and the third fin 54 together. The portion on the second fin 52 for connecting to the support structure may be configured in a variety of ways. In the illustrated embodiment, the second fin 52 includes a pair of recesses 92 at the leading edge 84 for receiving support structure and a pair of recesses 94 at the trailing edge 86 for receiving support structure.

Similar to the first fin 50, the second fin 52 is fixed relative to the cylindrical sidewall 30. The second fin 52 may be fixed relative to the cylindrical sidewall 30 by any suitable method. In the illustrated embodiment, the second fin 52 is attached to the inner surface 34 by welds 96. The welds 96 may be evenly paced apart along both the first lateral edge 88 and the second lateral edge 90. In one embodiment, the welds 96 include welds about 1½ inches long along both the first lateral edge 88 and the second lateral edge 90 adjacent to both the leading edge 84 and the trailing edge 86 and one or more welds about 1 inch long positioned between the 1½ inch welds.

Likewise, the third fin 54 includes a first face 100, a second face 102 generally parallel to and opposite the first face 102, a leading edge 104 extending between the first face 100 and the second face 102, a trailing edge 106 opposite the leading edge 104 and extending between the first face 100 and the second face 102, a first lateral edge 108 extending between the leading edge 104 and the trailing edge 106, and a second lateral edge 110 opposite the first lateral edge 108 and extending between the leading edge 104 and the trailing edge 106. The third fin 54 has a width W3 that is generally constant along its length. In other embodiments, however, the width W3 of the third fin 54 may vary along its length.

The third fin 54 may include a portion configured to connect to supporting structure that connects the first fin 50, the second fin 52, and the third fin 54 together. The portion on the third fin 52 for connecting to the support structure may be configured in a variety of ways. In the illustrated embodiment, the third fin 54 includes a pair of recesses 112 at the leading edge 104 for receiving support structure and a pair of recesses 114 at the trailing edge 106 for receiving support structure.

Similar to the first fin 50 and the second fin 52, the third fin 54 is fixed relative to the cylindrical sidewall 30. The third fin 54 may be fixed relative to the cylindrical sidewall 30 by any suitable method. In the illustrated embodiment, the third fin 54 is attached to the inner surface 34 by welds 116 extending along the entire first lateral edge 108 and the second lateral edge 110.

The elbow 24 includes support structure that supports and connects the first fin 50, the second fin 52, and the third fin 54 together. The support structure can be configured in a variety of ways. Any structure capable of increasing the structural strength of the fins can be used. In the illustrated embodiment, the elbow 24 include one or more support strips extends between and connect the fins 50, 52, 54. The one or more support strips may be configured and arranged in a variety of ways. For example, the length, thickness, cross-sectional shape, number of, location of, and materials used for the supports strips may vary is different embodiments.

In the illustrated embodiment, the elbow 24 includes a first support strip 120, a second support strip 122, a third support strip 124, and a fourth support strip 126. In other embodiments, however, more or less than four support strips may be used. In the illustrated embodiment, the first support strip 120 and the second support strip 122 are adjacent the leading edges 64, 84, 104 of the fins 50, 52, 54 and the third support strip 124 and the fourth support strip 126 are adjacent the trailing edges 66, 86, 106 of the fins 50, 52, 54. In other embodiments, the first support strip 120 and the second support strip 122 may be formed as a single strip and the third support strip 124 and a fourth support strip 126 may be formed as a single strip.

As shown in FIGS. 2-4, the first support strip 120 is a generally thin, elongated strip of material having a rectangular cross-section, a curved portion 130 with a radius Rs1, and a straight portion 132. The first support strip 120 has a length Ls, a width Ws, and a thickness Ts. In the exemplary embodiment, the width Ws is in the range of about 10 mm to about 14 mm or about 12 mm and the thickness Ts is in the range of about 2 mm to about 4 mm or about 3 mm.

The first support strip 120 can be made of any suitable material. In the illustrated embodiment, the first support strip 120 is made of 11 GA sheet metal.

In the illustrated embodiment, the first support strip 120, the second support strip 122, the third support strip 124, and the fourth support strip 126 are configured substantially the same. Therefore, the description of the first support strip 120 applies equally to the other supports strips 122, 124, 126. Thus, the second support strip 122 includes a curved portion 140 and a straight portion 142, the third support strip 124 includes a curved portion 144 and a straight portion 146, and the fourth support strip 126 includes a curved portion 148 and a straight portion 150.

In other embodiments, however, the supports strips 122 may be configured differently from each other. For example, in the illustrated embodiment, the radius of the curved portions 130, 140, 144, 146 of the first support strip 120, the second support strip 122, the third support strip 124, and the fourth support strip 126, respectively, are the same. In other embodiments, however, one or more of the curved portions 130, 140, 144, 146 may have a radius different from one or more of the other curved portions 130, 140, 144, 146.

When assembled, the first support strip 120 is connected to the inner surface 34 of the elbow 24 and to each of the fins 50, 52, 54. The first support strip 120 may be connected to the inner surface 34 and fins 50, 52, 54 in a variety of ways. In the illustrated embodiment, the curved portion 130 of the first support strip 120 is connected to the inner surface 34 of the elbow 24 by welds 160. The straight portion 132 is received in one of the recesses of each of the pair of recesses 72, 92, 112 on the leading edges 64, 84, 104 of the fins 50, 52, 54 and secured in place by welds 162. Thus, the first support strip 120 connects a first point on the first fin 50 to a second point on the second fin 52 and the second point on the second fin 52 to a third point on the third fin 54. Each of the connected points being spaced apart from the inner surface 34. In the illustrated embodiment, the connected points are linearly aligned since they are connected by the straight portion 132. In other embodiments, however, the support strips may not connect to the fins via a straight portion, thus, the connected point may not be linearly aligned The first support strip 120, in addition to attaching the fins 50, 52, 54 together at points that are radially inward of the inner surface 34, also attaches those points to the inner surface 34 of the elbow 24. The straight portion 132 extends a distance X past the recess 112 in the third fin 54 but does not engage the inner surface 34 of the elbow 24 opposite where the curved portion 130 is welded to the inner surface 34.

Similar to the first support strip 50, the curved portion 140 of the second support strip 122 is welded to the inner surface 34 of the elbow 24 near, or at the same point as, the curved portion 130 of the first support strip 120 such that the first support strip 120 and the second support strip 122 form a U-shape. The straight portion 142 of the second support strip 122 is received, and welded in place, in the other recess of the pair of recesses 72, 92, 112 that the first support strip 120 is attached to. As with the first support strip 120, the straight portion 142 of the second support strip 122 extends a short distance past the recess 112 in the third fin 54 but does not engage the inner surface 34 of the elbow 20 opposite where the curved portion 140 is welded to the inner surface 34.

The recess of the pair of recesses 72 in which the straight portion 132 of the first support strip 120 attaches is a first distance D1 from the first lateral edge 68 of the first fin 50. The recess of the pair of recesses 72 in which the straight portion 142 of the second support strip 122 attaches is a second distance D2 from the second lateral edge 70 of the first fin 50. The pair of recesses 72 are positioned a third distance D3 apart from each other.

In the illustrated embodiment, the first distance D1 is equal to the second distance D2 and the third distance D3 is greater than the first distance D1 and the second distance D2. In other embodiments, however, the first distance D1 and the second distance D2 may be different and the third distance D3 may be equal to or less than either the first distance D1 or the second distance D2. In one exemplary embodiment, the ratio of D1 to D3 is in the range of 0.75 to 1.25.

The description of the spacing of the pair of recesses 72 with respect to the lateral edges 68, 70 and to each other applies equally to the pair of recesses 74 on the trailing edge, the pairs of recesses 92, 94 on the second fin 52, and the pairs of recesses 112, 114 on the third fin 54. For example, in one embodiment, the second fin 52 is positioned at or near the middle of the flow channel 36. Thus, the second fin 52 bisects, or nearly bisects, the flow channel 36. In this position, the width of the second fin 52 is equal to, or nearly equal to, the inside diameter of the elbow 24. The pairs of recesses 92, 94 on the second fin 52 are positioned such that each of the pair of recesses 92, 94 trisects, or nearly trisects, the width of the second fins 52 at the leading edge 84 and trailing edge 86, respectively. Thus, the distance from the first lateral edge 88 to one of the recesses 92 is equal to, or nearly equal to, the distance from the second lateral edge 90 to the other recess. Further, the distance between both recesses of the pair of recesses 92 is equal to the distance from the first lateral edge 88 to one of the recesses 92. By trisecting, or nearly trisecting, the widest of the fins, the unsupported width of the fin, at the leading and trailing edge, is minimized.

The third and fourth support strips 124, 126 attach to the trailing edges 66, 86, 106 of the fins 50, 52, 54 similarly to how the first and second support strips 120, 122 attach to the leading edges 64, 84, 104 of the fins 50, 52, 54. Thus, the curved portion 144 of the third support strip 124 is connected to the inner surface 34 of the elbow 24 by welds 174 and the straight portion 146 is received in, and welded to, one of the recesses of the pair of recesses 74, 94, 114 on the trailing edges 66, 86, 106 of the fins 50, 52, 54. As with the first and second support strips 120, 122, the straight portion 146 of the third support strip 124 extends a short distance past the recess 114 in the third fin 54 but does not engage the inner surface 34 of the elbow 24 opposite where the curved portion 144 is welded to the inner surface 34.

The curved portion 148 of the fourth support strip 126 is welded to the inner surface 34 of the elbow 24 near, or at the same point as, the curved portion 144 of the third support strip 124 such that the third support strip 124 and the fourth support strip 126 form a U-shape. The straight portion 150 of the fourth support strip 126 is received, and welded in place, in the other recess of the pair of recesses 74, 94, 114 on the trailing edges 66, 86, 106 of the fins 50, 52, 54. than the third support strip 124. As with the third support strip 124, the straight portion 150 of the fourth support strip 126 extends a short distance past the recess 114 in the third fin 54 but does not engage the inner surface 34 of the elbow 24 opposite where the curved portion 144 is welded to the inner surface 34.

INDUSTRIAL APPLICABILITY

The engine and exhaust aftertreatment system 10 may be utilized in a variety of applications. For example, the engine and exhaust aftertreatment system 10 may be used to power a mobile machine, such as locomotives, ships, construction equipment, off-highway and on-highway trucks, or used in a stationary application, such as a Genset. The exhaust conduit 20 routes exhaust from the engine 12 into the exhaust aftertreatment system 14. Due to space constraints in many applications, the exhaust conduit 20 may have multiple curves and bends. For example, the elbow 24 may be positioned at the inlet 26 to the exhaust aftertreatment system 14. The fins 50, 52, 54 serve as flow conditioners to reduce the amount of swirl in the exhaust that would typically result when exhaust flows through an elbow.

Due to the type of application and the proximity of the elbow 24 to the engine 12 and turbochargers 16, the elbow 24 and the fins 50, 52, 54 are subject to thermal stresses and vibration-related stresses, which can damage the fins 50, 52, 54 and the welds 76, 96, 116 securing the fins 50, 52, 54 to the inner surface 34. The support strips 120, 122, 124, 126 and spaced apart welds 76, 96 on the lateral edges of the first and second fins 50, 52 help to compensate for the stresses in the elbow 24.

For example, the support strips 120, 122, 124, 126 may increase the structural strength of the fins 50, 52, 54 and help reduce stress. Fins connected only at their lateral edges to the inner surface 34 of the sidewall 30 of the elbow 24 can experience fluttering or resonance of the portion of the fins inward of the lateral edges. The support strips 120, 122, 124, 126 connect the fins 50, 52, 54 together, and to the inner surface 34, at a location on the fins 50, 52, 54 that is radially inward of the lateral edges of the fins. As a result, the support strips 120, 122, 124, 126, can change the natural frequency of the fins 50, 52, 54 and increase the stiffness of the fins 50, 52, 54, thereby reducing or eliminating fluttering.

Furthermore, the curved portion 130, 140, 144, 148 of each of the support strips 120, 122, 124, 126 may compensate for thermal expansion and vibration. As opposed to a linear support, the curved portion 130, 140, 144, 148 can accommodate thermal expansion resulting in stress being concentrated in the curved portion of the support strips 120, 122, 124, 126 rather than in the welds 160 that attach the support strips 120, 122, 124, 126 to the inner surface 34. By concentrating the stress in the curved portion 130, 140, 144, 148, the likelihood of stress-induced damage to the welds 160 may be decreased.

In addition, the welds 76, 96 that attach the first fin 50 and second fin 52 to the inner surface 34 are spaced apart along the lateral edges 68, 70, 88, 90 of the first fin 50 and second fin 52. The spaced-apart welds 76, 96 may reduce the stress in those welds resulting from thermal expansion of the fins and sidewalls 32, as compared to full welds that extend along the entire length of the lateral edges.

In view of the many possible embodiments to which the principles of the disclosure can be applied, it should be recognized that the illustrated embodiments are only preferred examples and should not be taken as limiting the scope of the disclosure. Rather the scope of the disclosure is defined by the following claims.

What is claimed is:

1. An exhaust conduit, comprising:

a wall having an inner surface that at least partially defines a flow channel;

a first fin positioned within the flow channel and attached to the inner surface, the first fin having a leading edge;

a second fin positioned within the flow channel and attached to the inner surface, the second fin having a second leading edge, wherein the first fin is spaced apart from the second fin;

a first support strip attached to the inner surface, attached to the first fin at a first location proximal the leading edge and spaced apart from the inner surface, and attached to the second fin at a second location proximal the second leading edge and spaced apart from the inner surface; and a second support strip attached to the inner surface, attached to the first fin at a third location proximal the leading edge and spaced apart from the inner surface, and attached to the second fin at a fourth location proximal the second leading edge and spaced apart from the inner surface;

wherein the exhaust conduit is an elbow pipe and the first fin and the second fin are configured to condition the flow of exhaust through the elbow pipe.

2. The exhaust conduit of claim 1, further comprising a third fin positioned within the flow channel and attached to the inner surface, the third fin having a third leading edge, wherein the first support strip is attached to the third fin at a fifth location proximal the third leading edge and spaced apart from the inner surface, and the second support strip is attached to the third fin at a sixth location proximal the third leading edge and spaced apart from the inner surface.

3. The exhaust conduit of claim 2, wherein the first location, the second location, and the fifth location are linearly aligned.

4. The exhaust conduit of claim 1, wherein the first support strip is received in a recess in the leading edge.

5. The exhaust conduit of claim 1, wherein the first support strip has a curved portion and a straight portion, and wherein the curved portion is attached to the inner surface and the straight portion is attached to the first fin and the second fin.

6. The exhaust conduit of claim 5, wherein the second support strip has a curved portion attached to the inner surface and a straight portion attached to the first fin and to the second fin.

7. The exhaust conduit of claim 6, wherein the straight portion of the first support strip is parallel to the straight portion of the second support strip.

8. The exhaust conduit of claim 6, wherein the first support strip and the second support strip form a U-shape.

9. The exhaust conduit of claim 6, wherein the straight portion of the first support strip is received in a first recess in the leading edge and the straight portion of the second support strip is received in a second recess in the leading edge.

10. The exhaust conduit of claim 9, wherein the first fin has a first lateral edge and a second lateral edge opposite the first lateral edge, and wherein the first recess is a first distance from the first lateral edge and the second recess is a second distance from the second lateral edge, and wherein the first distance is equal to the second distance.

11. The exhaust conduit of claim 1, further comprising a third support strip, wherein the first fin has a trailing edge opposite the leading edge, and wherein third support strip is received in a recess in the trailing edge.

12. The exhaust conduit of claim 1, wherein the first support strip and the second support strip are formed as a single strip.

13. An exhaust conduit, comprising:

a wall having an inner surface that at least partially defines a flow channel;

a first fin positioned within the flow channel and attached to the inner surface;

a second fin positioned within the flow channel and attached to the inner surface, the first fin spaced apart from the second fin;

a first support strip having a first curved portion and a first straight portion, wherein the first curved portion is attached to the inner surface, and the first straight portion is attached to the first fin at a first location spaced apart from the inner surface and is attached to the second fin at a second location spaced apart from the inner surface; and a second support strip having a second curved portion and a second straight portion, wherein the second curved portion is attached to the inner surface, and the second straight portion is attached to the first fin at a third location spaced apart from the inner surface and attached to the second fin at a fourth location, wherein the first fin has a leading edge, and wherein the first straight portion of the first support strip is received in a first recess in the leading edge and the second straight portion of the second support strip is received in a second recess in the leading edge, wherein the first fin has a first lateral edge and a second lateral edge opposite the first lateral edge, and wherein the first recess is a first distance from the first lateral edge and the second recess is a second distance from the second lateral edge, and the first recess is a third distance from the second recess, and wherein the first distance is equal to the second distance and the third distance is greater than the first distance, wherein the exhaust conduit is an elbow pipe and the first fin and the second fin are configured to condition the flow of exhaust through the elbow pipe.

14. An engine system, comprising:

an engine;

an exhaust aftertreatment system;

an exhaust conduit arranged to direct exhaust from the engine into the exhaust aftertreatment system, the exhaust conduit including:

a wall having an inner surface that at least partially defines a flow channel;

a first fin positioned within the flow channel and attached to the inner surface, the first fin having a leading edge;

a second fin positioned within the flow channel and attached to the inner surface, the second fin having a second leading edge, wherein the first fin is spaced apart from the second fin;

a first support strip attached to the inner surface, attached to the first fin at a first location proximal the leading edge and spaced apart from the inner surface, and attached to the second fin at a second location proximal the second leading edge and spaced apart from the inner surface; and a second support strip attached to the inner surface, attached to the first fin at a third location proximal the leading edge and spaced apart from the inner surface, and attached to the second fin at a fourth location proximal the second leading edge and spaced apart from the inner surface, wherein the exhaust aftertreatment system has an inlet and the exhaust conduit is an elbow pipe attached to the inlet, and wherein the first fin and the second fin are configured to condition the flow of exhaust through the elbow pipe.

15. The engine system of claim 14, wherein the first support strip and the second support strip form a U-shape.

16. A method of supporting a plurality of fins in an exhaust conduit, each of the plurality of fins having a first lateral edge, a second lateral edge opposite the first lateral edge, and a leading edge extending between the first lateral edge and the second lateral edge, the method comprising:

attaching the first and second lateral edges of a first fin to an inner surface of the exhaust conduit;

attaching the first and second lateral edges of a second fin to the inner surface;

connecting a first point on the first fin, that is proximal the leading edge of the first fin, to a second point on the second fin, that is proximal the leading edge of the second fin, wherein the first point and the second point are radially inward from the inner surface;

connecting the first point to the inner surface at a location spaced apart from the first and second lateral edges of the first fin, connecting a third point on the first fin, that is proximal the leading edge of the first fin, to a fourth point on the second fin, that is proximal the leading edge of the second fin, wherein the third point and the fourth point are radially inward from the inner surface; and connecting the third point to the inner surface at a location spaced apart from the first and second lateral edges of the first fin, wherein the exhaust conduit is an elbow pipe and the first fin and the second fin are configured to condition the flow of exhaust through the elbow pipe.

17. The method of claim 16, further comprising:

attaching the first and second lateral edges of a third fin to the inner surface; and connecting a fifth point on the third fin, that is proximal the leading edge of the third fin, to the second point on the second fin, wherein the fifth point is radially inward from the inner surface;

connecting a sixth point on the third fin, that is proximal the leading edge of the third fin, to the fourth point on the second fin, wherein the sixth point is radially inward from the inner surface.

18. The method of claim 16, wherein the first point, the second point, and the fifth point are linearly aligned.

* * * * *